United States Patent [19]

Belpaume

[11] 4,121,302

[45] Oct. 24, 1978

[54] ARTICLES OF CLOTHING

[75] Inventor: Charles Belpaume, Bouc Bel Air, France

[73] Assignee: Innovations pour L'Elegance Masculine, France

[21] Appl. No.: 606,646

[22] Filed: Aug. 21, 1975

[30] Foreign Application Priority Data

Aug. 21, 1974 [FR] France ..... 74 29185

[51] Int. Cl.[2] ..... A41B 9/06

[52] U.S. Cl. ..... 2/113

[58] Field of Search ..... 2/113, 67; 128/536, 128/518 R

[56] References Cited

U.S. PATENT DOCUMENTS

| | | | |
|---|---|---|---|
| 1,110,749 | 9/1914 | De Bliexux | 2/113 |
| 1,977,329 | 10/1934 | Tobin | 2/113 |

FOREIGN PATENT DOCUMENTS

| | | | |
|---|---|---|---|
| 1,595,916 | 6/1970 | France | 2/113 |

*Primary Examiner*—Doris L. Troutman

*Attorney, Agent, or Firm*—Robert E. Burns; Emmanuel J. Lobato; Bruce L. Adams

[57] ABSTRACT

An article of clothing for enveloping the upper part of the body, particularly garments and undergarments of this type manufactured for men, women and children, having an extension to its back-piece in the form of a shaped flap of curved lower contour, provided with elastic means and with its concavity facing upwards, the flap being arranged to envelop and rest on and under the buttocks for the purpose of preventing the article of clothing riding up when the user bends forward or makes any large amplitude movement, the article of clothing being particularly adapted for sports and leisure garments.

3 Claims, 5 Drawing Figures

ARTICLES OF CLOTHING

This invention relates to articles of clothing, and in particular to light articles of clothing for enveloping the upper part of the body, and more particularly to a garment or undergarment, such as a knitted vest, pullover, shirt, or sports shirt, especially for tennis, in which the back portion is maintained in ideal shape.

The majority of garments covering the upper part of the body, such as shirts, pullovers and vests, have sacrificed their functional aspect for the aesthetic aspect, often for reasons of fashion. The cutting methods are dictated by the constant desire to give the garment new appearance and shape characteristics agreeable to the eye, for purposes of attracting the gaze of others and drawing attention to the wearer. The comfort of the wearer is thus sacrificed for the benefit of the attractive or special and singular appearance which characterizes the garment.

Thus, nearly all these garments ride up at their waist as soon as the wearer makes the smallest rapid movement or a movement to any particular extent. The desire to maintain a correct bearing prevents the wearer from completely relaxing.

There is one known solution which would seem to overcome these disadvantages, and it relates to a category of garments, more particularly undergarments, known by the name of "bodies." These are body-fitting garments which completely envelop the bust, the trunk and hips, the lower part acting as pants and the upper part as a shirt. The rear part cannot ride up ungracefully because the front and rear pieces are joined together at the bottom of the garment by a tail flap.

These undergarments have had a certain success, and have found large-scale distribution in the form of feminine undergarments, and are available in large ranges of sizes. However, these garments and undergarments do not give the results which one might expect, because mass-production does not allow articles to be made which are perfectly adapted to each wearer, while for reasons of comfort, such a garment must be able to adjust itself perfectly to all covered parts of the body.

This becomes particularly sensitive for female users whose measurements comprise one extra parameter, namely the chest circumference. Thus for two persons of the same stature but of different busts, tugging and creasing may be produced. More generally, a garment of a certain size worn by a stocky girl with a large chest circumference will tend to crease at the middle of the back and around her abdomen, while in the case of a slender girl with a smaller chest the garment will tend to tug.

The frequent disagreeable and inconvenient riding up of the rear part is therefore replaced by the more disagreeable sensations of tugging and creasing. Sport becomes inconvenient and the garment becomes uncomfortable, and the wearer feels ill at ease and ceases to wear such a garment or undergarment.

For men, there existed a garment of the same type of style in the form of one-piece bathing costumes of the 1900 style, one-piece undergarments covering the back, the chest, the kidneys, the buttocks and the male organs. These are no longer worn, as they left the wearer with the disagreeable impression of being a prisoner in his garment, or on the contrary of feeling loose on all sides, with the garment hanging badly.

The present invention provides an article of clothing for enveloping the upper part of the body having an extension to its rear piece in the form of a shaped flap of curved lower contour, provided with elastic means and with its concavity facing upwards and, the flap being arranged to envelope and rest on and under the buttocks for preventing the article of clothing riding up.

The article of clothing may for example ride up when the wearer bends forward, or makes any large amplitude movements, in particular arm movements which cause the shoulders to rise.

Because of its special cut, its assembly and the characteristics of the fabric used, the article of clothing according to the invention keeps properly in place on the body for any rapid and/or large amplitude body movement, notably movement of the trunk and shoulders.

This advantage is particularly appreciated in the practice of games in which body expressions are concerned, in particular sports such as tennis, basketball, or volley-ball etc. The wearer feels properly at ease and may adopt relaxed attitudes without fearing ungraceful riding up or disagreeable creasing or tugging.

By blocking the rear flap under the buttocks, the garment is given perfect anchorage in the two main directions of movement, namely lateral movements (twisting of the trunk) and bending and bust extension movements.

The fabrics of which the articles of clothing are made are of the flat surface type, and in order to obtain an effective enveloping effect and a good hold on the salient parts of the body, they must possess special characteristics and be in strict contact with the skin at the more important places of support of the garment.

The fabric is disposed in such a manner that the preferential direction of elongation is in the direction of movement so as to take full advantage of this and not only of its components.

The articles of clothing are preferably made of extensible fabric of even mesh in the vertical direction. Use is preferably made of knitted fabrics of the jersey type produced on warp looms or circular looms, the mesh giving the knitted fabric the natural elasticity necessary for the article. One particular example of a fabric may be one comprising 100% cotton or 35% cotton and 65% polyester.

The columns of stitches are arranged in the longitudinal direction. The pieces are cut out in such a manner that the line of these columns is parallel to the vertical line of the vertebral column.

The invention will be further described, by way of example only, with reference to the accompanying drawing, in which.

Figure 4:
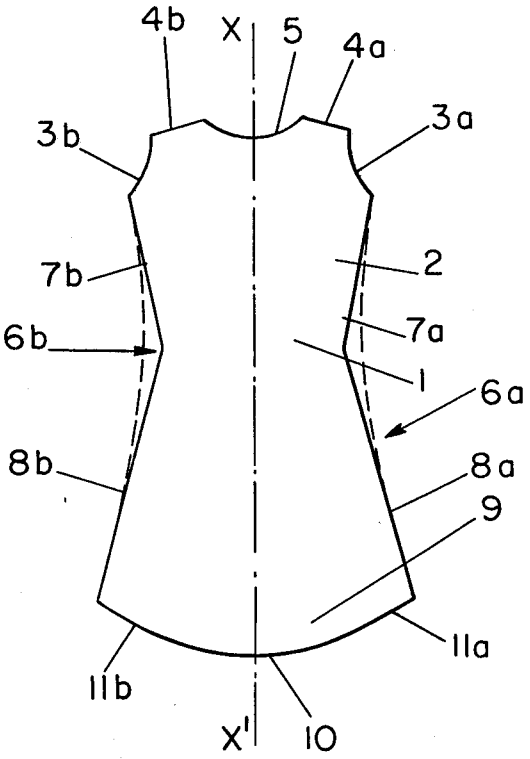
FIG. 4 is a plan view of a cut-out for the rear piece of an article of clothing according to the invention.
Figure 3:
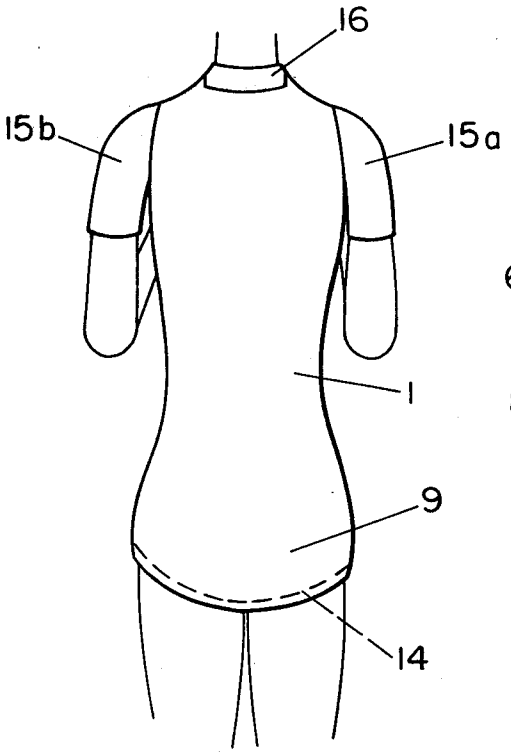
FIG. 3 is a rear view of an article of clothing according to the invention.

Reference is first made to FIG. 4, which shows the rear piece 1 in the non-worn state, i.e. not on the body of the wearer. The rear piece 1 has a symmetrical structure about an axis XX' and comprises an upper part 2 cut out in such a manner as to include two indentations 3*a* and 3*b* to which sleeves are intended to be fitted. These indentations extend upwards in the form of two straight, slightly inclined sides 4*a* and 4*b* connected together by a slightly curved neck-line 5, with its concavity facing upwards.

This rear piece is bordered on each of its sides by lateral edges 6*a* and 6*b* each formed from two straight upper and lower segments 7*a*, 7*b* and 8*a*, 8*b* which diverge and which are disposed in pairs to form a V with a large angle of opening facing outwards and which is slightly variable with the size of the garment. These segments could be replaced on each side by a lateral curved cut represented by broken lines in FIG. 4. The ratio of the length of the upper segment to the length of the lower segment is approximately two-thirds.

The rear piece terminates at the bottom in a shaped flap 9 with a slightly curved side 10, its concavity facing upwards, and its radius of curvature being almost constant at its central part but increasing rapidly towards the lateral segments 8*a* and 8*b* to rejoin them along straight portions 11*a* and 11*b*. The angles of intersection are obtuse, and are approximately 120°.

Figure 5:
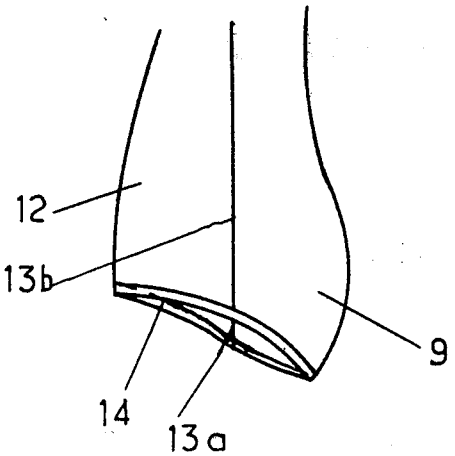
FIG. 5 is a detailed perspective view of the bottom of an article of clothing according to the invention.

A front piece 12 of length less than that of the rear piece forms the front of the garment (see FIG. 5). The flap 9 forms a shaped lower extension, the effect of which is obtained by its special cut and by the assembly of the lateral segments 8*a* and 8*b* to the front piece 12 by way of lateral straight seams 13*a* and 13*b* which start from under the arms and rejoin the bottom of the garment at the middle of its sides.

The flap shaping is reinforced by the ratio of the length of the front to the rear piece, the top part of the rear piece to the bottom part of the rear piece, the radius of curvature of the side 10 and the value of the angle of divergence between the sides 8*a* and 8*b*, which is of the order of 30° but which may be greater. The composition and characteristics of the yarn and fabric utilized, and the extensible stitches ensure the most enveloping effect and the strictest contact possible with the skin.

Figure 1:
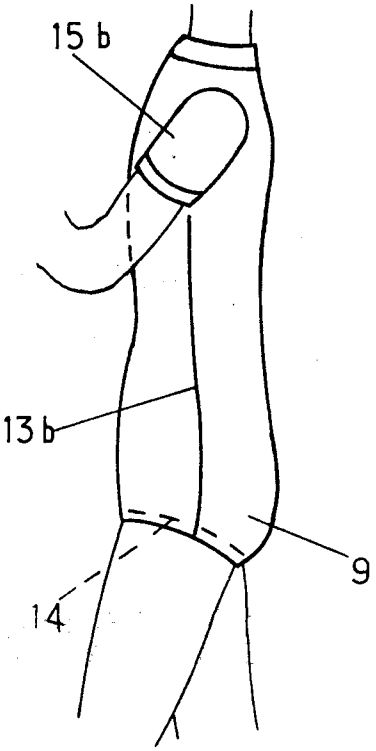
FIG. 1 is a profile view of one embodiment of an article of clothing according to the invention, more especially for male use.
Figure 2:
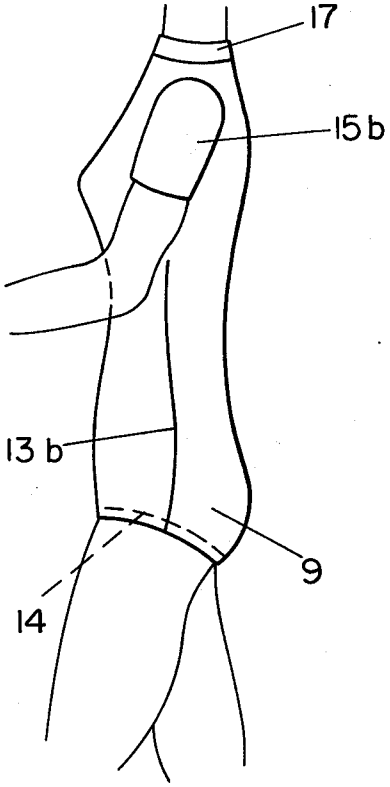
FIG. 2 is a profile view of a similar embodiment of an article of clothing according to the invention, more especially for female use.

The bottom of the garment is bordered along the entire circumference and on the reverse side of the fabric by an elastic ribbon 14 of length about 30% less than the circumference of the body to be contained (see FIGS. 1 and 2) in such a manner that the elastic ribbon is always stretched by one-third of its initial length and, together with the particular elasticity of the fabric, allows its efficient blockage under the buttocks. This ribbon may stretch to double its length.

The shaped extension is designed to envelop the buttocks, and the elastic ribbon placed at its end is supported under the buttocks. The garment is thus fixed under the buttocks, and this suppresses ungraceful folds and disagreeable riding up, and ensures that the garment is always perfectly correctly held for any rapid and/or large amplitude movement by the wearer.

The finish of the article of clothing may vary according to the fashion and aesthetic effect required, and is independent of the technical characteristics concerned. Long or short sleeves 15*a* and 15*b* may be fitted to the article of clothing, and a rectangular collar piece 16 may be attached to give a close neck collar or the collar may be extended into a roll neck.

Various modifications may be made within the scope of the invention, which may be applied to articles of clothing with different collar shapes, such as conventional, roll neck, special neck, short neck collar, and tapering collar shapes. Slight modifications to the dimensions or the ratio of dimensions may be made without affecting the invention where the same means are employed for the same purpose.

I claim:

1. An article of clothing for enveloping the upper part of the body comprising; front and rear pieces with said rear piece having an extension in the form of a shaped flap so that said rear piece is longer than said front piece, said shaped flap having a curved lower contour with its concavity facing upwards and configured to fit under the buttocks and possessing sufficient elasticity to assure good holding and support of the buttocks to thereby avoid creeping or riding up of the article bottom along the buttocks, the lower posterior portion of said shaped flap having a pronounced anatomical curvature defined by the combination of the article fabric being comprised of longitudinally and laterally extensible fibers, by said rear piece having two sides defined by straight V-shaped edges when the article is in the nonworn state and each of which defines a substantial opening angle opening towards the outside and both sides being separated from one another at their bottom ends by a curved edge defining said curved lower contour and by an elastic ribbon surrounding the lower portion of the article and which can be extended one-third of its initial relaxed length.

2. An article of clothing according to claim 1; wherein said rear piece is symmetrical about a central axis and comprises an upper part cut out to form on each side indentations extending upwards in the form of two straight slightly inclined sides joined together by a slightly curved neckline with upwardly facing concavity, said rear piece being bordered on each of its sides by lateral edges each in the form of two straight upper and lower segments which converge with an opening angle of about 60°.

3. An article of clothing according to claim 1; wherein said curved lower portion has a concavity turned upwards and a radius of curvature which is substantially constant over the central part and which increases abruptly towards lateral segments, said lateral segments joining straight portions at intersection points at equal obtuse angles of about 120°.

* * * * *